US006863574B1

(12) United States Patent
Bosch

(10) Patent No.: US 6,863,574 B1
(45) Date of Patent: Mar. 8, 2005

(54) PLUG ASSEMBLY

(76) Inventor: Johannes Cornelius N. Bosch, P.O. Box 3346, Montana Park, Pretoria (ZA), 0159

( * ) Notice: Subject to any disclaimer, the term of this patent is extended or adjusted under 35 U.S.C. 154(b) by 0 days.

(21) Appl. No.: 10/817,168

(22) Filed: Apr. 5, 2004

(51) Int. Cl.[7] ..... H01R 25/00
(52) U.S. Cl. ..... 439/651; 439/638
(58) Field of Search ..... 439/638, 651, 439/652, 653, 654

(56) References Cited

U.S. PATENT DOCUMENTS 2,597,600 A * 5/1952 Hyman ..... 439/651
3,242,455 A 3/1966 Horvsih et al.
4,248,494 A * 2/1981 McDonald et al. ..... 439/638
4,605,273 A 8/1986 Horton
5,071,370 A * 12/1991 Kochan, Jr. ..... 439/651
5,171,155 A 12/1992 Mendoza
5,921,799 A 7/1999 Forrester
5,931,702 A * 8/1999 Fladung ..... 439/652
D413,570 S 9/1999 Intveld
6,045,374 A * 4/2000 Candeloro ..... 439/652
6,155,880 A * 12/2000 Yu ..... 439/652
6,234,823 B1 5/2001 Fuess

* cited by examiner

*Primary Examiner*—Tho D. Ta

(57) ABSTRACT

A plug assembly includes a plug adapter with a front side, a back side, a first lateral side and a second lateral side. The back side has a pair of slots therein positioned adjacent to and extending along one of the first and second lateral sides such that flanges are defined. A pair of male plugs is attached to and extends away from the front side. Each of a plurality of cords has a female plug coupler electrically attached thereto and adapted for selectively coupling with one of the flanges such that the cords extend laterally away from the plug adapter. A plurality of electrical contacts is mounted in the slot and on the female plug couplers for electrically coupling the female plug couplers to the plug adapter. The electrical contacts in the slots are electrically coupled to an associated one of the male plugs.

6 Claims, 3 Drawing Sheets

PLUG ASSEMBLY

BACKGROUND OF THE INVENTION

1. Field of the Invention

The present invention relates to plug devices and more particularly pertains to a new plug device which prevents accidental removal of the plug from an electrical socket.

2. Description of the Prior Art

The use of plug devices is known in the prior art. U.S. Pat. No. 6,234,823 describes a device for securing a male plug to a plug adapter to allowing 120 volt plug to be connected to alternate power supplies. Another power supply plug is found in U.S. Pat. No. 5,921,799 which describes a locking mechanism for a power plug.

While these devices fulfill their respective, particular objectives and requirements, the need remains for a device that prevents a power cord from being too easily removed from a power socket and also allows for multiple outlets from one socket.

SUMMARY OF THE INVENTION

The present invention meets the needs presented above by including a power adapter that is conventionally coupled to a socket but couples to power cords in such a manner that the power cords extend laterally away from the adapter. In this way, when an appliance such as a vacuum cleaner, or other device, is plugged into the power adapted, the power cord is not removed from the adapter when tension is placed on it. Also, the power adapter itself is not pulled out easily from the socket by the power cords because pulling on the power cords places lateral force on the power adapter as opposed to the power adapted being pulled outwardly away from the socket as happens with conventional adapters.

To this end, the present invention generally comprises a plug adapter including a front side, a back side, a top side, a bottom side, a first lateral side and a second lateral side. The back side has a pair of slots therein. Each of the slots is adjacent to and extends along one of the first and second lateral sides such that flanges are defined between the slots and an adjacent one of the first and second lateral sides. A pair of male plugs is attached to and extends away from the front side. Each of a plurality of cords has a female plug coupler electrically attached thereto and adapted for selectively coupling with one of the flanges such that the cords extend laterally away from the plug adapter. A plurality of electrical contacts is mounted in the slot and on the female plug couplers for electrically coupling the female plug couplers to the plug adapter. The electrical contacts in the slots are electrically coupled to an associated one of the male plugs.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
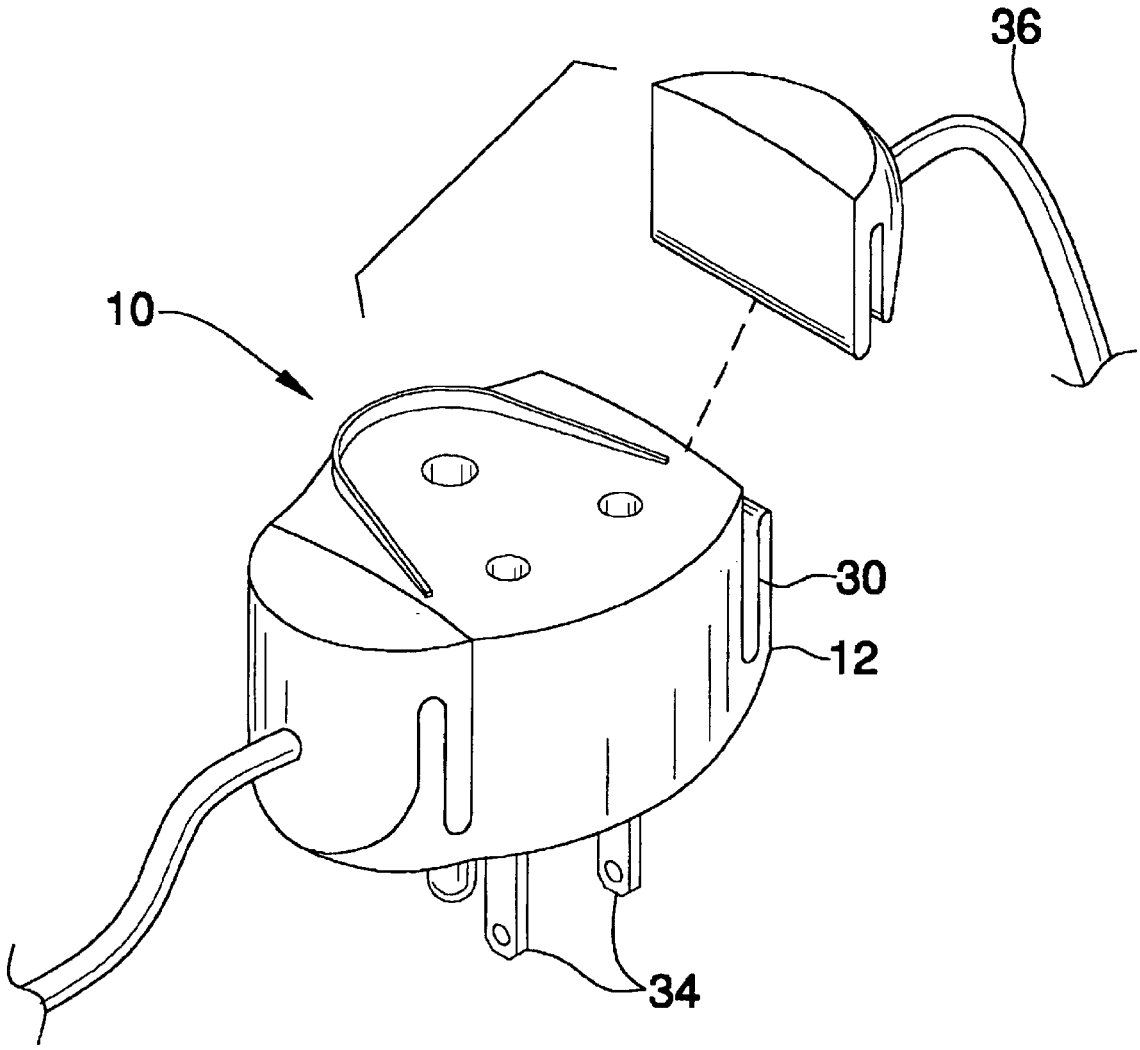
FIG. 1 is a schematic perspective view of a plug assembly according to the present invention.
Figure 2:
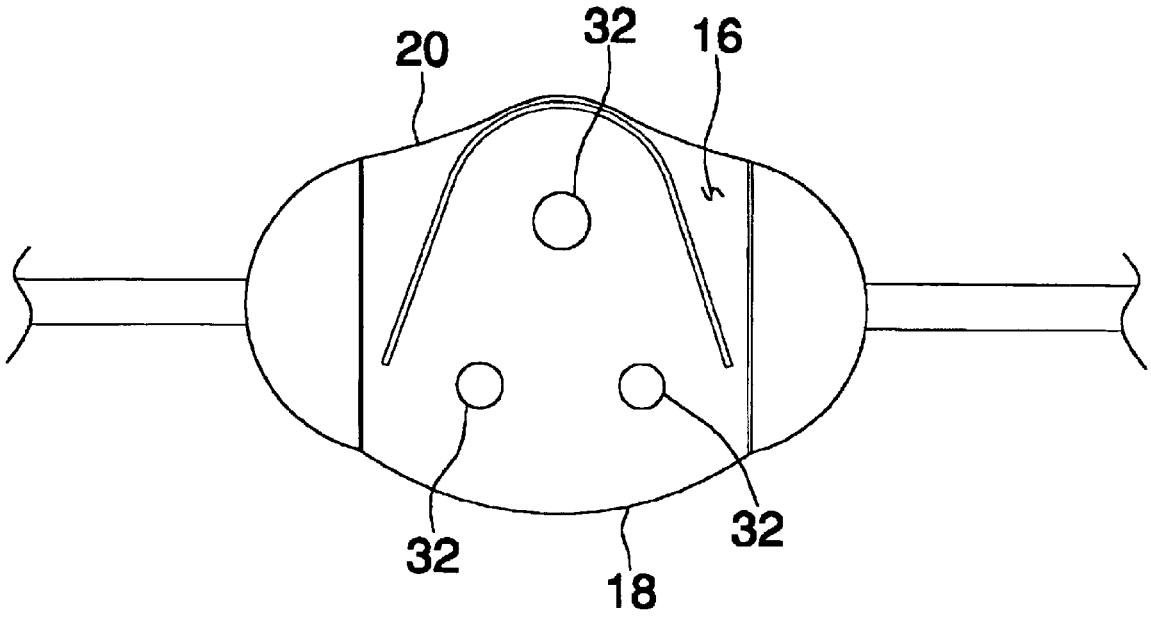
FIG. 2 is a schematic back side view of the present invention.
Figure 3:
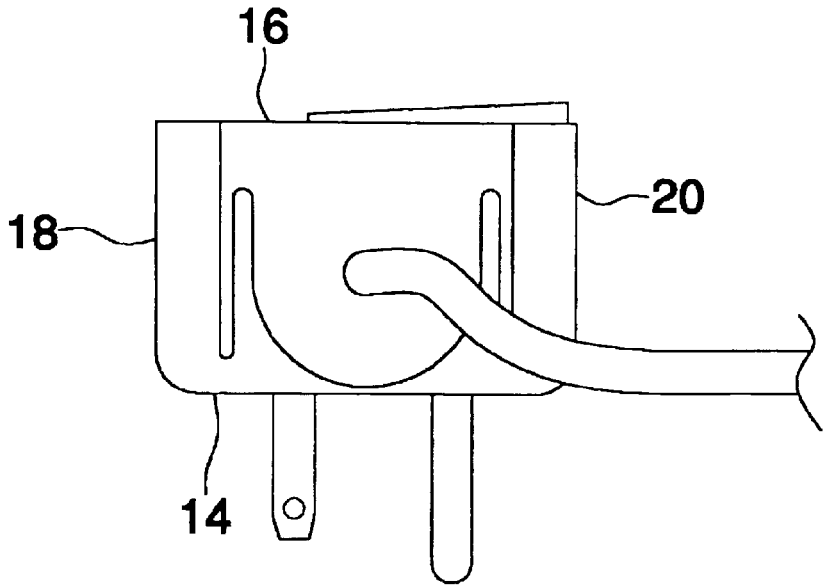
FIG. 3 is a schematic left view of the present invention.
Figure 5:
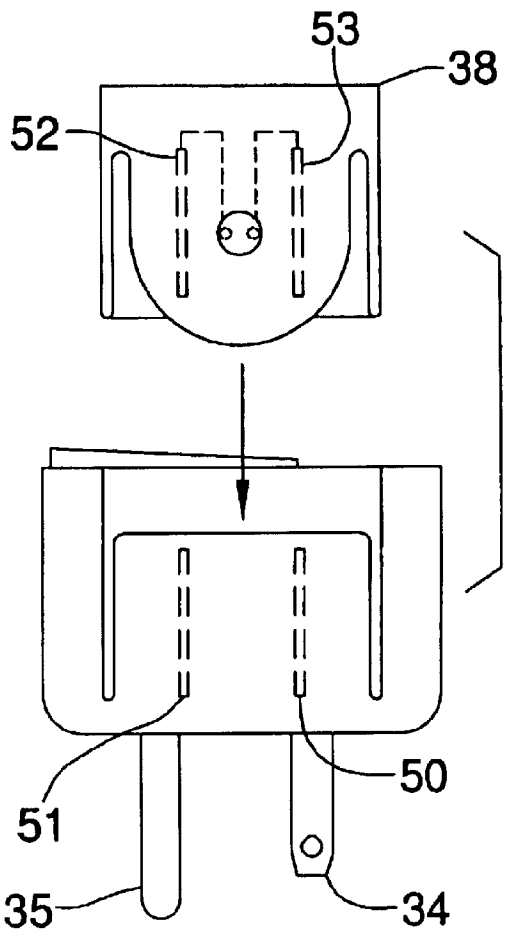
FIG. 5 is a schematic right side view of the present invention.

With reference now to the drawings, and in particular to FIGS. 1 through 5 thereof, a new plug device embodying the principles and concepts of the present invention and generally designated by the reference numeral 10 will be described.

As best illustrated in FIGS. 1 through 5, the plug assembly 10 generally includes a plug adapter 12 with a front side 14, a back side 16, a top side 18, a bottom side 20, a first lateral side 22 and a second lateral side 24. The back side 16 has a pair of slots 26 therein. Each of the slots 26 is adjacent to and extends along one of the first 22 and second 24 lateral sides such that flanges 30 are defined between the slots 26 and an adjacent one of the first 22 and second 24 lateral sides. The back side 16 has a plurality of apertures 32 therein each defining a female plugs. A plurality of male plugs 34 is attached to and extends away from the front side. Each of the male plugs 34 is electrically coupled to an associated one of the female plugs 32. Ideally, there are two current transferring male and female plugs and one grounding male 35 and female plug. The male plugs 34 are located for positioning in a conventional socket and the apertures 32 are positioned for receiving the male plugs of a conventional electrical cord.

Each of a plurality of cords 36 each has a female plug coupler 38 electrically attached thereto adapted for selectively coupling with one of the flanges 30 such that the cords 36 extend laterally away from the plug adapter 12. The cords 36 may have a second end, not shown, that is electrically coupled to an electrically powered device or a conventional female plug such that cord 36 is used as an extension cord. The plug couplers 38 each include a first panel 40 and a second panel 42 that are attached together along an edge by a central portion 44 such that a cavity 46 is defined between the first 40 and second 42 panels. The cavity 46 has a size and shape adapted for receiving one of the flanges 30 such that the first panel 40 is positioned within the slot 26. The central portion 44 is substantially flush with the back side 16 of the plug adapter 12 when the flange 30 is positioned within the cavity 46. An attached one of the plurality of cords 36 extends away from the second panel 42. Ideally, an outer surface of the second panel 42 is arcuate shaped.

Each of a plurality of electrical contacts 50, 51, 52, 53 is utilized for electrically coupling the female plug couplers to the plug adapter. The electrical contacts are each mounted in one of the slots 26 and the cavities 46 such that each of the slots 26 have a pair of electrical contacts 50, 51 therein and each of the first panels 40 has a pair of electrical contacts 52, 53 therein. Each of the electrical contacts 50, 51 in the slots 26 is electrically coupled to one of the male plugs 34 used for conducting electricity. The electrical contacts 50, 51 in the slots 26 are mounted on the flanges 30. The electrical contacts 52, 53 in the cavities 46 are mounted on the first panels 40 and face the flanges 30. The electrical contacts 52, 53 on the first panels 40 and each is positioned for engaging an associated one of the electrical contacts 50, 51 in the slots 26.

Figure 4:
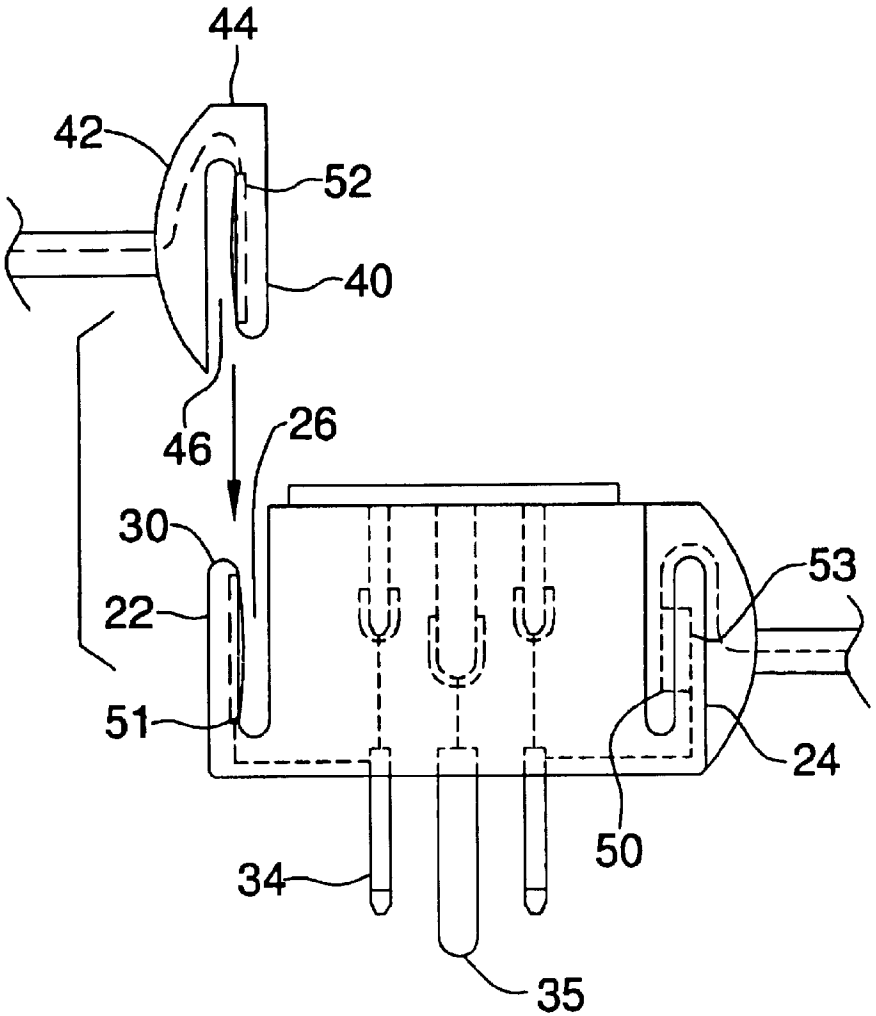
FIG. 4 is a schematic top view of the present invention.

In use, the plug adapter 12 and female plug couplers 38 are used in a conventional manner as a typical power supply. The female plug couplers 38 are attached to the flange 30 as depicted in FIGS. 1 and 4 so that the electrical contacts 52, 53 on the female plug couplers 38 are in electrical connection with the male plugs 34. Conventional plugs may be inserted into the apertures 32 to increase the usage of the assembly 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to bc encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plug assembly including:

a plug adapter including a front side, a back side, a top side, a bottom side, a first lateral side and a second lateral side, said back side having a pair of slots therein, each of said slots being adjacent to and extending along one of said first and second lateral sides such that flanges are defined between said slots and an adjacent one of said first and second lateral sides, a pair of male plugs being attached to and extending away from said front side;

a plurality of cords each having a female plug coupler electrically attached thereto adapted for selectively coupling with one of said flanges such that said cords extend laterally away from said plug adapter; and a plurality of electrical contacts being mounted in said slots and on said female plug couplers for electrically coupling said female plug couplers to said plug adapter, said electrical contacts in said slots being electrically coupled to an associated one of said male plugs.

2. The plug assembly of claim 1, wherein said back side of said plug adapter has a plurality of apertures therein each defining a female plugs, each of said male plugs being electrically coupled to an associated one of said female plugs.

3. The plug assembly of claim 1, wherein each of said plug couplers includes a first panel and a second panel being attached together along an edge by a central portion such that a cavity is defined between said first and second panels, said cavity having a size and shape adapted for receiving one of said flanges such that said first panel is positioned within said slot.

4. The plug assembly of claim 3, wherein said central portion is substantially flush with said back side of said plug adapter when said flange is positioned within said cavity.

5. The plug assembly of claim 3, wherein each of said electrical contacts is mounted in one of said slots and said cavities such that each of said slots have a pair of said electrical contacts therein and each of said first panels having a pair of said electrical contacts therein, said electrical contacts in said slots being mounted on said flanges, said electrical contacts in said cavities being mounted on said first panels and facing said flanges, said electrical contacts on said first panels being positioned for engaging an associated one of said electrical contacts in said slots.

6. A plug assembly including:

a plug adapter including a front side, a back side, a top side, a bottom side, a first lateral side and a second lateral side, said back side having a pair of slots therein, each of said slots being adjacent to and extending along one of said first and second lateral sides such that flanges are defined between said slots and an adjacent one of said first and second lateral sides, said back side having a plurality of apertures therein each defining a female plugs, a plurality of male plugs being attached to and extending away from said front side, each of said male plugs being electrically coupled to an associated one of said female plugs;

a plurality of cords each having a female plug coupler electrically attached thereto adapted for selectively coupling with one of said flanges such that said cords extend laterally away from said plug adapter, each of said plug couplers including;

a first panel and a second panel being attached together along an edge by a central portion such that a cavity is defined between said first and second panels, said cavity having a size and shape adapted for receiving one of said flanges such that said first panel is positioned within said slot, said central portion being substantially flush with said back side of said plug adapter when said flange is positioned within said cavity, wherein an attached one of said plurality of cords extends away from said second panel; and a plurality of electrical contacts for electrically coupling said female plug couplers to said plug adapter, each of said electrical contacts being mounted in one of said slots and said cavities such that each of said slots have a pair of said electrical contacts therein and each of said first panels having a pair of said electrical contacts therein, each of said electrical contacts in said slots being electrically coupled to one of said male plugs, said electrical contacts in said slots being mounted on said flanges, said electrical contacts in said cavities being mounted on said first panels and facing said flanges, said electrical contacts on said first panels being positioned for engaging an associated one of said electrical contacts in said slots.

* * * * *